US010329906B2

(12) United States Patent
Zheng et al.

(10) Patent No.: US 10,329,906 B2
(45) Date of Patent: Jun. 25, 2019

(54) ACOUSTIC SOURCE TESTING APPARATUS OF AZIMUTHALLY ACOUSTIC LOGGING WHILE DRILLING (LWD) INSTRUMENT

(71) Applicant: Institute of Geology and Geophysics, Chinese Academy of Sciences, Beijing (CN)

(72) Inventors: Jian Zheng, Beijing (CN); Zili Wang, Beijing (CN); Wenxuan Chen, Beijing (CN); Qingyun Di, Beijing (CN); Yuntao Sun, Beijing (CN); Yongyou Yang, Beijing (CN); Wenxiu Zhang, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/104,076

(22) Filed: Aug. 16, 2018

(65) Prior Publication Data

US 2019/0055840 A1 Feb. 21, 2019

(30) Foreign Application Priority Data

Aug. 16, 2017 (CN) ..... 2017 1 0702676

(51) Int. Cl.
*E21B 49/00* (2006.01)
*H04R 29/00* (2006.01)

(52) U.S. Cl.
CPC ..... *E21B 49/00* (2013.01); *H04R 29/001* (2013.01)

(58) Field of Classification Search
CPC ..... E21B 49/00; H04R 29/001
See application file for complete search history.

(56) References Cited

FOREIGN PATENT DOCUMENTS

| | | | |
|---|---|---|---|
| CN | 105257282 A | | 1/2016 |
| CN | 106593421 A | * | 4/2017 |
| CN | 106703793 A | * | 5/2017 |
| CN | 106837677 A | * | 6/2017 |
| CN | 107558993 A | * | 1/2018 |
| CN | 107605473 A | * | 1/2018 |

(Continued)

OTHER PUBLICATIONS

Translation of SU 711515 A (Year: 1980).*
Chinese Patent Office, First office action and first search report for CN 201710702676.9, dated Apr. 28, 2018.

*Primary Examiner* — Daniel Pihulic
(74) *Attorney, Agent, or Firm* — Novick, Kim & Lee, PLLC; Allen Xue

(57) ABSTRACT

An acoustic source testing apparatus of an azimuthally acoustic logging while drilling (LWD) instrument includes a water tank, a silicone oil, a drill collar, an azimuthally acoustic while drilling quadrupole transmitting apparatus and an acoustic signal reception apparatus. The bottom of the water tank is symmetrically provided with two supporting columns, the drill collar is disposed in U-shaped grooves on the supporting columns, the azimuthally acoustic quadrupole LWD transmitting apparatus and the acoustic signal reception apparatus are disposed on the drill collar, the silicone oil is filled in the water tank, and the drill collar, the azimuthally acoustic quadrupole LWD transmitting apparatus and the acoustic signal reception apparatus are completely covered in the silicone oil.

7 Claims, 3 Drawing Sheets

(56) References Cited

FOREIGN PATENT DOCUMENTS

| | | | | |
|---|---|---|---|---|
| CN | 107610435 | A | * | 1/2018 |
| CN | 107656140 | A | * | 2/2018 |
| CN | 107605473 | B | * | 8/2018 |
| SU | 711515 | A1 | | 1/1980 |

* cited by examiner

ACOUSTIC SOURCE TESTING APPARATUS OF AZIMUTHALLY ACOUSTIC LOGGING WHILE DRILLING (LWD) INSTRUMENT

TECHNICAL FIELD

The present invention belongs to a logging while drilling (LWD) technology, and particularly relates to an acoustic source testing apparatus of an azimuthally acoustic LWD instrument.

BACKGROUND

With the increasing drilling scale of oil and gas fields and the development of science and technology, especially the rapid development of a LWD technology, it is urgent to make the present advanced science and technology play an important role in the development of the oil and gas fields. An azimuthally acoustic LWD technology is one of the LWD technology. Acoustic LWD enables acoustic logging while drilling, which can effectively detect lithological characters, physical properties and reservoir parameters of a wellbore wall formation. With the development of an acoustic LWD instrument, an acoustic quadrupole LWD instrument has been developed because it can obtain more information about the formation. The acoustic quadrupole LWD instrument is higher in requirements for transmitting and receiving transducers relative to acoustic monopole and dipole LWD instrument. Meanwhile, the acoustic quadrupole LWD instrument proposes extremely high requirements for consistency in resonant frequencies and transmitted signal strengths of the transmitting transducers and receiving sensitivity of the transmitting transducers because of taking functions of the acoustic monopole and dipole LWD instruments into account. Performance instability of the transmitting transducers and the receiving transducers under a free state and an installation state results in more difficulty in obtaining the transmitting transducers and the receiving transducers with high consistency and high sensitivity.

An acoustic source testing method of existing azimuthally acoustic LWD is to obtain key indicators such as consistency in transmitted signal strengths and resonance frequencies, and acoustic signal reception sensitivity of an acoustic source (i.e., transmitting transducers and receiving transducers) of the azimuthally acoustic LWD through an impedance analyzer and a silencer pool test during the development of the transmitting transducers and the receiving transducers. However, in an application of the azimuthally acoustic LWD instrument, when the transmitting transducers and the receiving transducers are installed on a drill collar, the transmitted signal strengths and the resonance frequencies of the transmitting transducers as well as the receiving sensitivity of the transmitting transducers are reduced, and the inconsistency is exhibited. This has caused great difficulties in the development of the azimuthally acoustic quadrupole LWD instrument.

When the transmitting transducers in the prior art are developed, the length of ceramic tiles within the transmitting transducers is increased, in order to increase transmitting powers of the transducers, and the ceramic tiles with a long-diameter ratio greater than 1:0.7 are stable in sintering and stable in resonant frequencies and signal transmission strengths, so that the consistency in the transmitted signal strengths and the resonant frequencies is deteriorated. A transmitting transducer with high consistency can be obtained only through post-screening, and in a conventional method, the resonant frequencies of the transducers can be indirectly obtained only by the impedance analyzer. On the other hand, after such the transmitting transducers and the receiving transducers are installed on the drill collar, their transmitted signal strengths and resonant frequencies are changed, so that the consistency of the individual transmitting transducers and the receiving sensitivity of the receiving transducers cannot be effectively verified.

SUMMARY

In order to solve the above problems, the present invention proposes an acoustic source testing apparatus of an azimuthally acoustic LWD instrument, which is simple in structure, convenient to use, and capable of effectively verifying the consistency of individual transmitting transducers and the receiving sensitivity of receiving transducers.

A technical solution of the present invention is as follows: an acoustic source testing apparatus of an azimuthally acoustic LWD instrument is characterized by including a water tank, a silicone oil, a drill collar, an azimuthally acoustic quadrupole LWD transmitting apparatus and an acoustic signal reception apparatus;

wherein the bottom of the water tank is symmetrically provided with two supporting columns, the drill collar is disposed in U-shaped grooves on the supporting columns, the azimuthally acoustic quadrupole LWD transmitting apparatus and the acoustic signal reception apparatus are disposed on the drill collar, the silicone oil is filled in the water tank, and the drill collar, the azimuthally acoustic quadrupole LWD transmitting apparatus and the acoustic signal reception apparatus are completely covered in the silicone oil.

Further, the azimuthally acoustic quadrupole LWD transmitting apparatus includes an electron emission bin, a sealing cover, a sealing connector, transmitting transducers, decoupling rubber pads and transmitting transducer protection cover plates;

wherein the electron emission bin is installed inside the drill collar, the transmitting transducers are disposed in grooves on an outer sidewall of the drill collar, and the decoupling rubber pads are disposed between the transmitting transducers and the drill collar, both ends of each of the transmitting transducer protection cover plates are fixedly connected with both ends of each of the grooves by screws, and the transmitting transducers are connected with the electron emission bin through signal excitation lines, and the signal excitation wires are sealed by the sealing cover and the sealing connector.

Further, the acoustic signal reception apparatus includes fixing clips, beam supports, fixing clip rubber blocks, receiving mounting bases, receiving transducers, receiving transducer decoupling rubber pads, receiving transducer protection cover plates, first positioning pins and second positioning pins;

wherein the fixing clips are symmetrically disposed on the outer sidewall of the drill collar at both ends of each of the transmitting transducer protection cover plates, the fixing clip rubber blocks are disposed between the fixing clips and the outer sidewall of the drill collar, the beam supports are fixedly connected with the fixing clips by the first positioning pins, the receiving mounting bases are fixed on the beam supports by the second positioning pins, the receiving transducers are installed on the receiving mounting bases, the receiving transducer protection cover plates are disposed above the receiving transducers and fixedly connected with the receiving mounting bases by screws, the receiving transducer decoupling rubber pads are disposed between the receiving transducers and the receiving mounting bases, and signal lines of the receiving transducers are connected with a receiving circuit.

Further, the number of the transmitting transducers is four, and the four transmitting transducers are disposed in the grooves on the outer sidewall of the drill collar at intervals of 90 degrees.

Further, the number of the receiving transducers is four, and the four receiving transducers are respectively disposed vertically above the transmitting transducers.

Further, each of the transmitting transducer protection cover plates includes an arc-shaped cover plate body and an elastic fixing structure;

wherein the fixing structure includes fixing holes, a first U-shaped through hole and a second U-shaped through hole, and the two fixing holes are symmetrically disposed in end portions of two ends of the arc-shaped cover plate body, each of the fixing holes is correspondingly disposed inside one of the first U-shaped through hole and the second U-shaped through hole, and an open end of the first U-shaped through hole is inserted into an open end of the second U-shaped through hole.

Further, each of the receiving transducer protection cover plates includes a U-shaped cover plate body and an elastic fixing structure;

wherein the fixing structure includes fixing holes, first U-shaped through holes and second U-shaped through holes, the plurality of fixing holes are symmetrically disposed in end portions of two ends of the U-shaped cover plate body, and each of the fixing holes is correspondingly disposed inside one of the first U-shaped through holes and the second U-shaped through holes, and open ends of the first U-shaped through holes are inserted into open ends of the second U-shaped through holes.

The present invention has advantageous effects that due to the adoption of the above technical solution, the apparatus of the present invention is composed of an azimuthally acoustic LWD transmitting apparatus and an acoustic receiving apparatus. The azimuthally acoustic LWD transmitting apparatus and the acoustic receiving apparatus are decoupled by a rubber pad block, effectively isolating the influence of drill collar waves on signal reception of the acoustic transmitting transducers and the acoustic receiving transducers. An azimuthally acoustic quadrupole LWD instrument has extremely high requirements for consistency in resonant frequencies and signal transmitting strengths of the transmitting transducers because of taking functions of azimuthally acoustic monopole, dipole and polarized pole LWD instruments into account. However, since the length of the transmitting transducers is increased to increase the transmitting powers when the transmitting transducers are developed, their consistency is deteriorated. The transmitting transducer with high consistency can be obtained only through post-screening, and in a conventional method, the resonant frequencies of the transducer can be indirectly obtained only by the impedance analyzer. On the other hand, after such the transmitting transducers and the receiving transducers are installed on the drill collar, their transmitted signal strengths and resonant frequencies are changed, so that the consistency of the individual transmitting transducers and the receiving sensitivity of the receiving transducer cannot be effectively verified. By means of the apparatus, effective monitoring of the consistency in transmitted signal strengths and resonant frequencies of the azimuthally acoustic quadrupole LWD transmitting transducers can be directly and effectively realized. Consistency monitoring deviations due to post-installation are eliminated by simulated installation of the transmitting transducers and the receiving transducers. Accordingly, monitoring the consistency in signal transmission strengths and resonant frequencies of the azimuthally acoustic LWD transmitting transducers and monitoring the receiving sensitivity of the acoustic receiving transducers are effectively realized. Meanwhile, multistage decoupling between the transmitting transducers and the receiving transducers minimizes the influence of drill collar waves on signal reception of the receiving transducers.

1. Water tank, 2. Silicone oil, 3. Supporting column, 4. Drill collar, 5. Electron emission bin, 6. Sealing cover, 7. Sealing connector, 8. First positioning pin, 9. Fixing clip, 10. Transmitting Transducer, 11. Beam support, 12. Receiving mounting base, 13. Decoupling rubber pad, 14. Transmitting transducer protection cover plate, 15. Receiving transducer, 16. Receiving transducer decoupling rubber pad, 17. Receiving transducer protection cover plate, 18. Second positioning pin, 19. Fixing clip rubber block.

DETAILED DESCRIPTION

A specific solution of the present invention will be further described below with reference to accompanying drawings.

Figure 1:
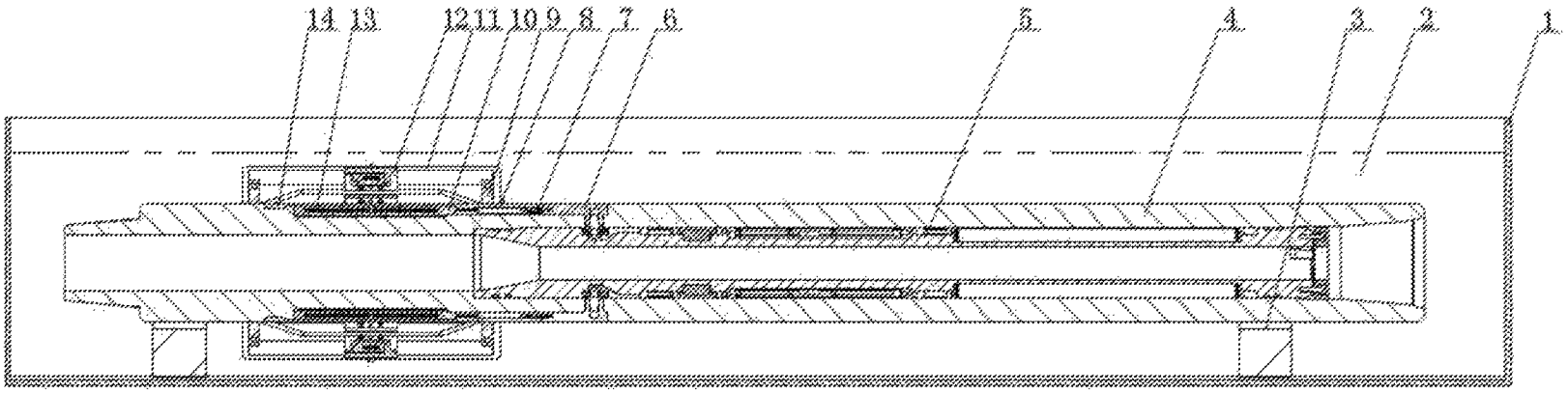
FIG. 1 is a schematic cross-sectional view showing an acoustic source testing apparatus of an azimuthally acoustic LWD instrument according to the present invention.
Figure 2:
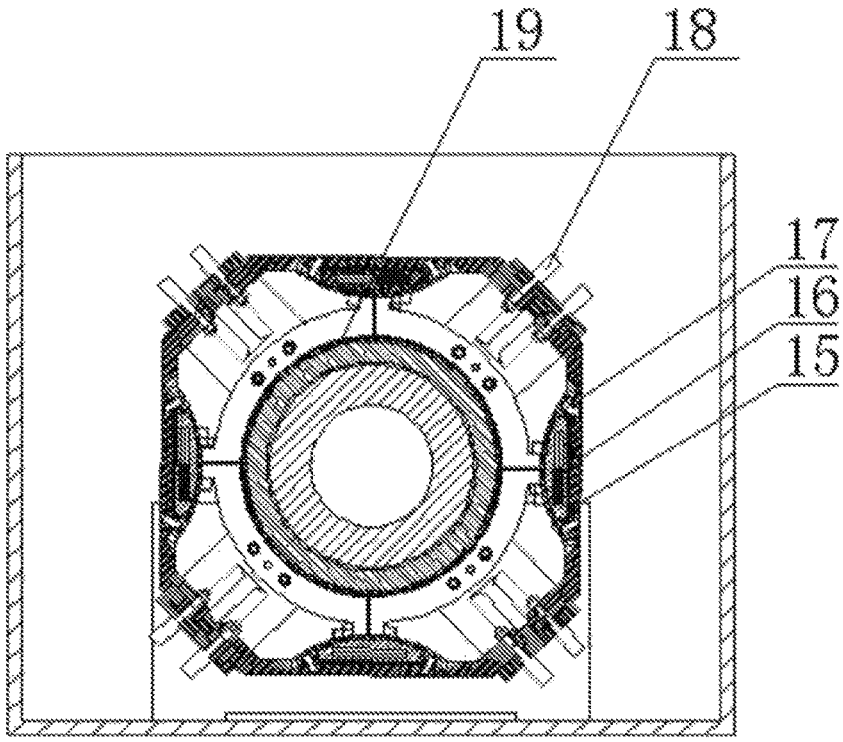
FIG. 2 is a schematic cross-sectional view showing a cross-sectional view of an acoustic source testing apparatus of an azimuthally acoustic LWD instrument according to the present invention.
Figure 3:
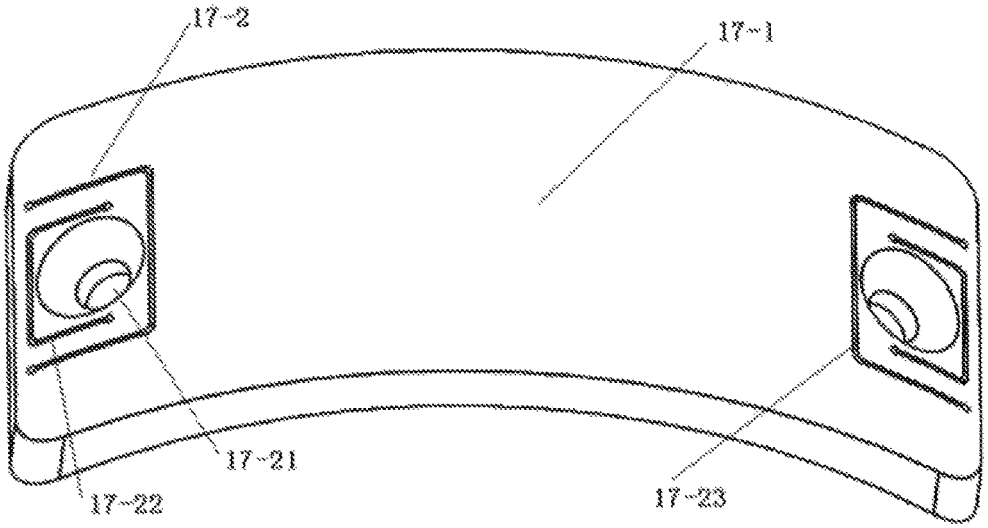
FIG. 3 is a schematic view showing a structure of a receiving transducer protection cover plate of the present invention.

As shown in FIG. 1 to FIG. 3, an acoustic source testing apparatus of an azimuthally acoustic LWD instrument includes a water tank 1, a silicone oil 2, a drill collar 4, an azimuthally acoustic quadrupole LWD transmitting apparatus and an acoustic signal reception apparatus;

wherein the bottom of the water tank 1 is symmetrically provided with two supporting columns 3, the drill collar 4 is disposed in U-shaped grooves on the supporting columns 3, the azimuthally acoustic quadrupole LWD transmitting apparatus and the acoustic signal reception apparatus are disposed on the drill collar 4, the silicone oil 2 is filled in the water tank 1, and the drill collar 4, the azimuthally acoustic quadrupole LWD transmitting apparatus and the acoustic signal reception apparatus are completely covered in the silicone oil 2.

Figure 5:
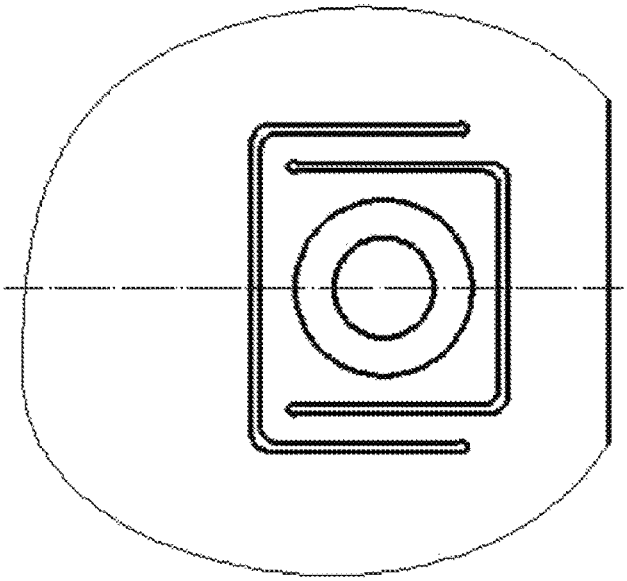
FIG. 5 is a schematic view showing a structure of an elastic fixing structure of the present invention.

The azimuthally acoustic quadrupole LWD transmitting apparatus includes an electron emission bin 5, a sealing cover 6, a sealing connector 7, four transmitting transducers 10, four decoupling rubber pads 13 and transmitting transducer protection cover plates 14;

wherein the electron emission bin 5 is installed inside a front end of the drill collar 4, the four transmitting transducers are uniformly disposed in grooves on an outer sidewall of the drill collar 4 at intervals of 90 degrees, the four decoupling rubber pads 13 are disposed between the four transmitting transducers 10 and the drill collar 4, so that it is possible to ensure that the transmitting transducers 10 are decoupled with the drill collar 4 by the decoupling rubber pads 13, formation and propagation of drill collar waves due to high-frequency vibrations of the transmitting transducers under the excitation of a circuit are reduced, and the four U-shaped transmitting transducer protection cover plates 14 are respectively disposed above the four transmitting transducers 10 for guaranteeing that two ends of each transmitting transducer protection cover plate 14 are fixed by screws and fixedly connected with two ends of each of the grooves. The transmitting transducer protection cover plates 14 form elastic installation structures of the cover plates by machining two U-shaped through holes with different sizes around installation holes, and structures of the U-shaped through holes are shown in FIG. 5. The structures may ensure even stress when the transmitting transducers 10 are installed, and prevent the transmitting transducers 10 from being damaged due to uneven stress. The transmitting transducers 10 are connected with the electron emission bin 5 through signal excitation lines, and the signal excitation wires are sealed with the drill collar 4 by the sealing cover 6 and the sealing connector 7.

The acoustic signal reception apparatus includes fixing clips 9, beam supports 11, fixing clip rubber blocks 19, receiving mounting bases 12, receiving transducers 15, receiving transducer decoupling rubber pads 16, receiving transducer protection cover plates 17, first positioning pins 8 and second positioning pins 18;

wherein the four fixing clips 9 as one group are uniformly disposed on an excircle of the drill collar 4 at intervals of 90 degrees, and fixed at one ends of the transmitting transducer protection cover plates 14, another group of fixing clips 9 are installed at the other ends of the transmitting transducer protection cover plates 14, and the fixing clip rubber block is installed at the bottom of each fixing clip 9 to realize decoupling with the drill collar 4. Each of the fixing clips 9 is aligned to a butt beam between the two transmitting transducer protection cover plates 14 by means of a center line on the fixing clip 9. Two ends of each of the beam supports 11 are fixed with the fixing clips 9 at two ends of the beam support 11 by means of first positioning pins 8 and mounting screws. The four beam supports 11 are respectively mounted on the fixing clips 9 at two ends of each of the beam supports 11, and uniformly distributed on an outer surface of the drill collar 4 at intervals of 90 degrees. Receiving transducer decoupling rubber pads 16 are adhered on bottom surfaces of the receiving transducers 15, and the receiving transducers 15 are fixed on the receiving mounting bases 12 by means of the receiving transducer protection cover plates 17. Similarly, the receiving transducer protection cover plates 17 form elastic installation structures of the cover plates by machining two U-shaped through holes with different sizes around installation holes, and structures of the U-shaped through holes are shown in FIG. 6. Two ends of each of the receiving mounting base are respectively fixed with the beam supports by means of the second positioning pins 18 and mounting screws. In this way, the receiving transducers 15 are distributed at middle positions of the transmitting transducers 10; and meanwhile, each receiving transducer 15 is positioned just above the transmitting transducers 10 which is in the same quadrant as that of the receiving transducer 15, so as to form receiving arrays in four directions. Highest signal strength may be accepted, and influences by other factors are eliminated.

As shown in FIG. 3, each of the transmitting transducer protection cover plates 17 includes an arc-shaped cover plate body 17-1 and an elastic fixing structure 17-2;

wherein the elastic fixing structure 17-2 includes fixing holes 17-21, a first U-shaped through hole 17-22 and a second U-shaped through hole 17-23, and the two fixing holes 17-21 are symmetrically disposed in end portions of two ends of the arc-shaped cover plate body 17-1, each of the fixing holes 17-21 is correspondingly disposed inside one of the first U-shaped through hole 17-22 and the second U-shaped through hole 17-23, and an open end of the first U-shaped through hole 17-22 is inserted into an open end of the second U-shaped through hole 17-23.

Figure 4:
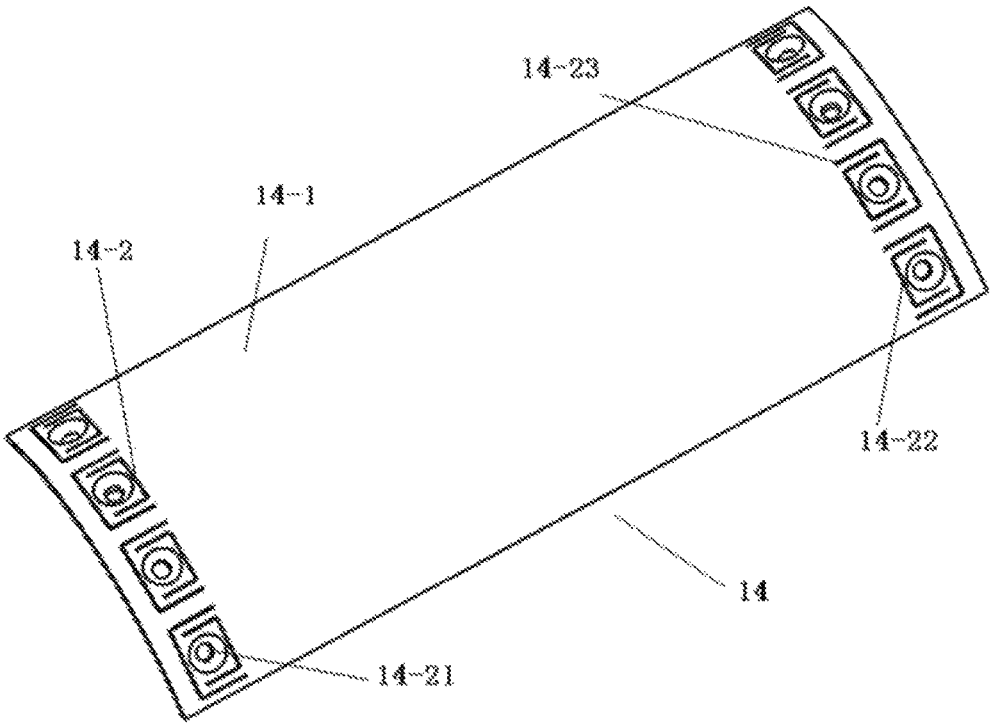
FIG. 4 is a schematic view showing a structure of a transmitting transducer protection cover plate of the present invention.

As shown in FIG. 4, each of the receiving transducer protection cover plates 17 includes a U-shaped cover plate body 14-1 and an elastic fixing structure 14-2;

wherein the elastic fixing structure 14-2 includes fixing holes 14-21, first U-shaped through holes 14-22 and second U-shaped through holes 14-23, the plurality of fixing holes 14-21 are symmetrically disposed in end portions of two ends of the U-shaped cover plate bodies 14-1, and each of the fixing holes 14-21 is correspondingly disposed inside one of the first U-shaped through holes 14-22 and the second U-shaped through holes 14-23, and open ends of the first U-shaped through holes 14-22 are inserted into open ends of the second U-shaped through holes 14-23.

In a practical application, an azimuthally acoustic quadrupole LWD transmitting apparatus is first assembled, an electron emission bin 5 is installed inside a drill collar 4, and locked by a rear locking screw, and transmitting transducers 10 are installed on an outer surface of the drill collar 4 by transmitting transducer protection cover plates 14, signal excitation lines of the transmitting transducers are connected to the electron emission bin 5 by a sealing cover 6 and a sealing connector 7, the azimuthally acoustic quadrupole LWD transmitting apparatus is powered by a power supply control switch on the electron emission bin 5, and transmitting modes of monopole, dipole, polarized pole and quadrupole are realized by a control circuit. Acoustic signal reception apparatuses are fixed on the drill collar 4 so as to be evenly distributed on both sides of each of the transmitting transducer protection cover plates 14, and a center line of each of fixing clips 9 is aligned to a beam-aligning line of every two transmitting transducer protection cover plates 14, such that receiving transducers 15 are positioned just above the transmitting transducers 10. Signal lines of the receiving transducers 15 are taken out to a receiving circuit, and the consistency in amplitudes of signals received by the four receiving transducers 15 is observed by an oscilloscope. Accordingly, signal transmissions of the azimuthally acoustic LWD transmitting transducers and the azimuthally acoustic LWD receiving transducers, as well as signal transmission strengths, and resonant frequencies and receiving sensitivity of the receiving transducers are monitored.

What is claimed is:

1. An acoustic source testing apparatus of an azimuthally acoustic LWD instrument, comprising a water tank (1), a silicone oil (2), a drill collar (4), an azimuthally acoustic quadrupole LWD transmitting apparatus and an acoustic signal reception apparatus;

wherein the bottom of the water tank (1) is symmetrically provided with two supporting columns (3), the drill collar (4) is disposed in U-shaped grooves on the supporting columns (3), the azimuthally acoustic quadrupole LWD transmitting apparatus and the acoustic signal reception apparatus are disposed on the drill collar (4), the silicone oil (2) is filled in the water tank (1), and the drill collar (4), the azimuthally acoustic quadrupole LWD transmitting apparatus and the acoustic signal reception apparatus are completely covered in the silicone oil (2).

2. The acoustic source testing apparatus of an azimuthally acoustic LWD instrument according to claim 1, wherein the azimuthally acoustic quadrupole LWD transmitting apparatus comprises an electron emission bin (5), a sealing cover (6), a sealing connector (7), transmitting transducers (10), decoupling rubber pads (13) and transmitting transducer protection cover plates (14);

wherein the electron emission bin (5) is installed inside the drill collar (4), the transmitting transducers (10) are disposed in grooves on an outer sidewall of the drill collar (4), and the decoupling rubber pads (13) are disposed between the transmitting transducers (10) and the drill collar (4), both ends of each of the transmitting transducer protection cover plates (14) are fixedly connected with both ends of each of the grooves by screws, and the transmitting transducers (10) are connected with the electron emission bin (5) through signal excitation lines, and the signal excitation wires are sealed by the sealing cover (6) and the sealing connector (7).

3. The acoustic source testing apparatus of an azimuthally acoustic LWD instrument according to claim 1, wherein the acoustic signal reception apparatus comprises fixing clips (9), beam supports (11), fixing clip rubber blocks (19), receiving mounting bases (12), receiving transducers (15), receiving transducer decoupling rubber pads (16), receiving transducer protection cover plates (17), first positioning pins (8) and second positioning pins (18);

wherein the fixing clips (9) are symmetrically disposed on the outer sidewall of the drill collar (4) at both ends of each of the transmitting transducer protection cover plates (14), the fixing clip rubber blocks (19) are disposed between the fixing clips (9) and the outer sidewall of the drill collar (4), the beam supports (11) are fixedly connected with the fixing clips (9) by the first positioning pins (8), the receiving mounting bases (12) are fixed on the beam supports (11) by the second positioning pins (18), the receiving transducers (15) are installed on the receiving mounting bases (12), the receiving transducer protection cover plates (17) are disposed above the receiving transducers (15) and fixedly connected with the receiving mounting bases (12) by screws, the receiving transducer decoupling rubber pads (16) are disposed between the receiving transducers (15) and the receiving mounting bases (12), and signal lines of the receiving transducers (15) are connected with a receiving circuit.

4. The acoustic source testing apparatus of an azimuthally acoustic LWD instrument according to claim 2, wherein the number of the transmitting transducers (10) is four, and the four transmitting transducers (10) are disposed in the grooves on the outer sidewall of the drill collar (4) at intervals of 90 degrees.

5. The acoustic source testing apparatus of an azimuthally acoustic LWD instrument according to claim 3, wherein the number of the receiving transducers (15) is four, and the four receiving transducers (15) are respectively disposed vertically above the transmitting transducers (10).

6. The acoustic source testing apparatus of an azimuthally acoustic LWD instrument according to claim 2, wherein each of the transmitting transducer protection cover plates (17) comprises an arc-shaped cover plate body (17-1) and an elastic fixing structure (17-2);

wherein the fixing structure (17-2) comprises fixing holes (17-21), a first U-shaped through hole (17-22) and a second U-shaped through hole (17-23), and the two fixing holes (17-21) are symmetrically disposed in end portions of two ends of the arc-shaped cover plate body (17-1), each of the fixing holes (17-21) is correspondingly disposed inside one of the first U-shaped through hole (17-22) and the second U-shaped through hole (17-23), and an open end of the first U-shaped through hole (17-22) is inserted into an open end of the second U-shaped through hole (17-23).

7. The acoustic source testing apparatus of an azimuthally acoustic LWD instrument according to claim 3, wherein each of the receiving transducer protection cover plates (14) comprises a U-shaped cover plate body (14-1) and an elastic fixing structure (14-2);

wherein the fixing structure (14-2) comprises fixing holes (14-21), first U-shaped through holes (14-22) and second U-shaped through holes (14-23), the plurality of fixing holes (14-21) are symmetrically disposed in end portions of two ends of the U-shaped cover plate body (14-1), and each of the fixing holes (14-21) is correspondingly disposed inside one of the first U-shaped through holes (14-22) and the second U-shaped through holes (14-23), and open ends of the first U-shaped through holes (14-22) are inserted into open ends of the second U-shaped through holes (14-23).

* * * * *